US011384474B2

(12) United States Patent
Kang et al.

(10) Patent No.: US 11,384,474 B2
(45) Date of Patent: Jul. 12, 2022

(54) WASHING MACHINE HAVING PIN MEMBER WITH SEPARATION PREVENTION PORTION

(71) Applicant: SAMSUNG ELECTRONICS CO., LTD., Suwon-si (KR)

(72) Inventors: Hee Jin Kang, Suwon-si (KR); Jeom Gap Kim, Yongin-si (KR); Jung Hwan Kim, Seongnam-si (KR); Ji Woong Park, Seoul (KR); Yong Kwon Won, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/473,067

(22) PCT Filed: Nov. 10, 2017

(86) PCT No.: PCT/KR2017/012743
§ 371 (c)(1),
(2) Date: Jun. 24, 2019

(87) PCT Pub. No.: WO2018/177418
PCT Pub. Date: Jun. 28, 2018

(65) Prior Publication Data

US 2019/0330782 A1 Oct. 31, 2019

(30) Foreign Application Priority Data

Dec. 23, 2016 (KR) ..... 10-2016-0178576

(51) Int. Cl.
*D06F 37/18* (2006.01)
*D06F 39/12* (2006.01)
*D06F 37/24* (2006.01)

(52) U.S. Cl.
CPC ..... *D06F 39/12* (2013.01); *D06F 37/24* (2013.01)

(58) Field of Classification Search
CPC ..... D06F 39/12; D06F 39/14; D06F 37/18; D06F 37/42; D06F 37/24
See application file for complete search history.

(56) References Cited

U.S. PATENT DOCUMENTS 5,584,549 A * 12/1996 Lybarger ..... D06F 39/12 220/835
2005/0012439 A1* 1/2005 Kim ..... D06F 39/12 312/228

(Continued)

FOREIGN PATENT DOCUMENTS

CN 204370179 6/2015
EP 2 354 294 A1 8/2011

(Continued)

OTHER PUBLICATIONS

International Search Report dated Feb. 26, 2018 from International Application No. PCT/KR2017/012743, 5 pages.

(Continued)

*Primary Examiner* — Michael E Barr
*Assistant Examiner* — Irina Graf
(74) *Attorney, Agent, or Firm* — Staas & Halsey LLP

(57) ABSTRACT

A washing machine includes a pin member coupled to an upper side of a cabinet and extending upwardly toward the upper side of the cabinet. The pin member passes through a through hole of a top cover which is engaged by the pin member. When the top cover is moved to the upper side of the cabinet, the through hole is hooked up in a section where the pin member is inclined upward. Accordingly, it is possible to restrict the top cover from moving to the upper side of the cabinet by a predetermined distance or more. The washing machine includes a fixing bracket that is laterally (Continued)

coupled to the lower flange of the cabinet to which the pin member is coupled.

14 Claims, 11 Drawing Sheets

(56) References Cited

U.S. PATENT DOCUMENTS

| | | | | |
|---|---|---|---|---|
| 2005/0179347 | A1 | 8/2005 | Kim et al. | |
| 2011/0248611 | A1 | 10/2011 | Hunnell et al. | |
| 2012/0216580 | A1* | 8/2012 | Chung | D06F 39/088 68/13 R |
| 2015/0145388 | A1 | 5/2015 | Jung et al. | |
| 2018/0044837 | A1* | 2/2018 | Kim | D06F 23/02 |

FOREIGN PATENT DOCUMENTS

| | | |
|---|---|---|
| KR | 2002-0042168 | 6/2002 |
| KR | 10-2006-0032069 | 4/2006 |
| KR | 10-2009-0013961 | 2/2009 |
| KR | 10-2015-0059319 | 6/2015 |
| KR | 10-2016-0084074 | 7/2016 |

OTHER PUBLICATIONS

Written Opinion of the International Searching Authority Feb. 26, 2018 from International Application No. PCT/KR2017/012743, 9 pages.

Extended European Search Report dated Sep. 16, 2019 in corresponding European Patent Application No. 17882901.6.

Chinese Office Action dated Dec. 25, 2020 from Chinese Application No. 201780087347.6, 19 pages.

Indian Office Action dated May 24, 2021 from Indian Application No. 201917029074.

Chinese Office Action dated Aug. 23, 2021 from Chinese Application No. 201780087347.6.

European Office Action dated Aug. 31, 2021 from European Application No. 17882901.6.

* cited by examiner

WASHING MACHINE HAVING PIN MEMBER WITH SEPARATION PREVENTION PORTION

CROSS-REFERENCE TO RELATED APPLICATIONS

This application is a U.S. National Stage Application which claims the benefit under 35 U.S.C. § 371 of International Patent Application No. PCT/KR2017/012743 filed on Nov. 10, 2017, which claims foreign priority benefit under 35 U.S.C. § 119 of Korean Patent Application No. 10-2016-0178576 filed on Dec. 23, 2016 in the Korean Intellectual Property Office, the contents of both of which are incorporated herein by reference.

TECHNICAL FIELD

The present disclosure relates to a washing machine, and more particularly, to a coupling of a top cover of a washing machine.

BACKGROUND ART

Generally, a washing machine is an apparatus configured to perform washing, rinsing, dehydration, and drying cycles to wash laundry.

Washing machines are classified into pulsator type washing machines in which a flow of water generated as rotating blades with small blades attached thereto rotate in a lower portion of a washing tub imparts force on laundry to wash the laundry, agitator type washing machines in which a rotational direction of large stirring blades with blades attached thereto at a center of a washing tub is regularly reversed to generate a flow of water so as to wash laundry, and drum type washing machines in which laundry is put in a drum and washed due to the detergency of a detergent and a force generated by the rising and falling of the laundry as the drum rotates.

In the case of the pulsator type, a top cover including a door of a washing machine is disposed at an upper side of the body, and when a force is applied to the washing machine due to abnormal rotation occurring during operation of the washing machine, the top cover may become separated from the body.

DISCLOSURE

Technical Problem

The present disclosure is directed to providing a washing machine of which a top cover is stably supported without becoming separated from a cabinet of the washing machine even when an impact or vibration is applied to the washing machine.

Technical Solution

In accordance with one aspect of the present disclosure, a washing machine may include a cabinet, a pin member disposed on an upper side of the cabinet, a top cover including a through hole through which the pin member passes and coupled to the upper side of the cabinet, and the pin member may include a coupling portion coupled to the cabinet, a separation prevention portion obliquely extending upward from the coupling portion to restrict movement of the top cover.

And the cabinet includes an upper flange bent from an upper end portion of the cabinet, and the upper flange includes a coupling hole into which the coupling portion is inserted.

And when the top cover is coupled to the upper flange, the through hole is located at a first location, and when the through hole is moved from the first location, the separation prevention portion comes into contact with at least a part of the through hole to restrict the movement of the top cover.

And an inclination angle of the separation prevention portion with respect to the upper flange is 35° or less.

And the washing machine further includes a fixing bracket coupled to the coupling portion below the upper flange to fix the coupling portion inserted into the coupling hole.

And the fixing bracket includes a fixing groove incised in one direction of the fixing bracket, and the fixing groove is coupled to the coupling portion in a lateral direction of the cabinet.

And the fixing bracket includes an auxiliary coupling hole to be vertically screw-coupled with the upper flange.

And the pin member extends downward from the coupling portion and further includes a binder configured to bind the fixing bracket to prevent the fixing bracket from becoming separated from the coupling portion, and a diameter of one side of the binder is provided to correspond to or be larger than a diameter of one side of the coupling portion.

And the pin member further includes a guide portion extending from the separation prevention portion in an upward direction of the cabinet so that the through hole is guided to be moved along the pin member.

And the pin member is located at a front portion of the upper flange.

And the washing machine further includes a hook member provided in a front portion of the fixing bracket and hook-coupled to the top cover.

And the washing machine further includes a screw coupling member disposed on a rear surface of the cabinet and configured to screw-couple the cabinet and the top cover.

And the through hole includes a long hole having a long side extending in a direction corresponding to a direction to which the separation prevention portion extends.

And the through hole is movable up to a second location configured to come into contact with at least one side of the separation prevention portion when moved from the first location, and when the through hole is located at the second location, the through hole is moved by the at least one side of the separation prevention portion so that the through hole returns to the first location.

And the pin member further includes a first location at which the through hole is located and a second location located above the first location, and a bent portion in which the second location is located obliquely upward from the first location so that the through hole is moved within a separation prevention distance defined as a lateral distance between the first location and the second location when the top cover becomes separated from the cabinet.

In accordance with another aspect of the present disclosure, a washing machine may include a cabinet, a top cover coupled to the upper side of the cabinet, and a pin member passed a through hole disposed inside of the top cover to prevent the top cover from becoming separated from the cabinet and including a first location at which the through hole is located, a second location located above the first location, and a bent portion in which the second location is located obliquely upward from the first location so that the through hole is moved within a separation prevention distance defined as a lateral distance between the first location and the second when the top cover becomes separated from the cabinet.

And the cabinet includes an upper flange bent from an upper end portion of the cabinet, and the pin member further includes a coupling portion extending downward from the bent portion and engaged with the upper flange.

And the washing machine further includes a fixing bracket coupled to the coupling portion below the upper flange to fix the coupling portion engaged with the upper flange.

And the pin member further includes a guide portion extending from the second location in an upward direction of the cabinet so that the through hole is guided to be moved along the pin member.

And an inclination angle of the bent portion with respect to the horizontal direction of the cabinet is 35 degrees.

In accordance with still another aspect of the present disclosure, a washing machine may include a cabinet having an upper flange bent from an upper end portion of the cabinet, a top cover disposed upper side of the upper flange, a pin member engaged with the upper flange to restrict movement of the top cover, and a fixing bracket coupled to the pin member below the upper flange to fix the pin member engaged with the upper flange, and the fixing bracket includes fixing groove incised in a side direction of the cabinet so that the pin member is inserted in the side direction of the cabinet, and a coupling hole formed in a vertical direction of the cabinet to engaged with the upper flange.

Advantageous Effects

Even when an impact or vibration is applied to a washing machine, since a top cover includes a pin member to be disposed on an upper portion of a cabinet, includes a through hole through which the pin member passes, and is coupled to the upper portion of the cabinet, the top cover can be prevented from becoming separated from the cabinet and can be stably supported.

MODES OF THE INVENTION

Figure 1:
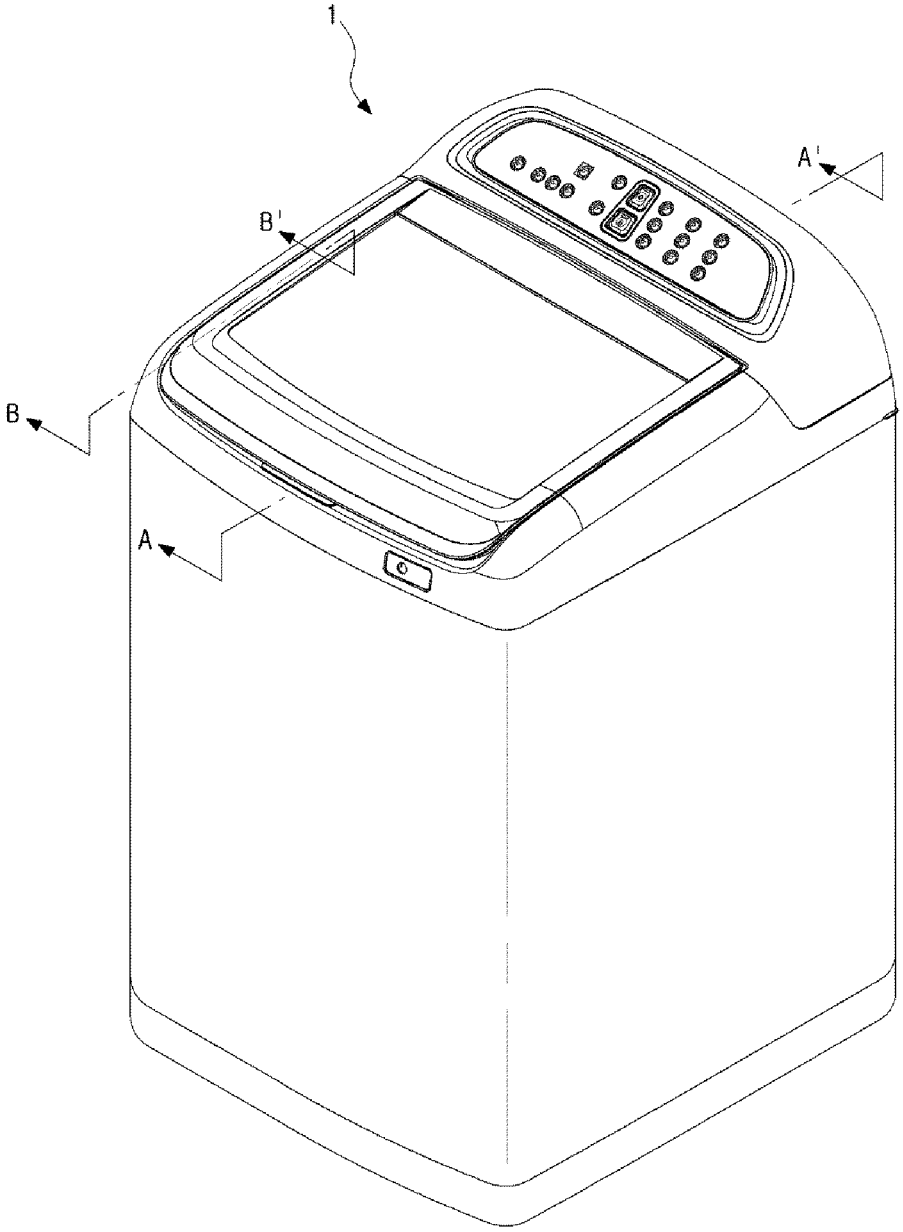
FIG. 1 is a perspective view of a washing machine according to an embodiment of the present disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Further, the terms "upper side," "upward direction," "lower side," "downward direction" used herein are related to a vertical direction of a washing machine according to one embodiment of the present disclosure shown in FIG. 1. That is, in FIG. 1, a side at which a door of the washing machine is disposed refers to the upper side, and a side opposite the upper side refers to the lower side.

Further, in the case of the terms "frontward direction," "rearward direction," "front surface side," "rear surface side" used herein, a direction in front of the washing machine in FIG. 1 refers to the frontward direction and a direction opposite the direction refers to the rearward direction.

Further, when viewed from the front, the left side of the washing machine shown in FIG. 1 refers to a left surface, and the right side thereof refers to a right surface.

Further, it is apparent that the washing machine according to the spirit of the present disclosure may be applied not only to a washing machine including an auxiliary washing space according to one embodiment, but also to a general washing machine that does not include an auxiliary washing space.

Hereinafter, embodiments according to the present disclosure will be described in detail with reference to the accompanying drawings. FIG. 1 is a perspective view of a washing machine according to one embodiment of the present disclosure, and FIG. 2 is a side sectional view taken along line A-A' in FIG. 1.

Figure 2:
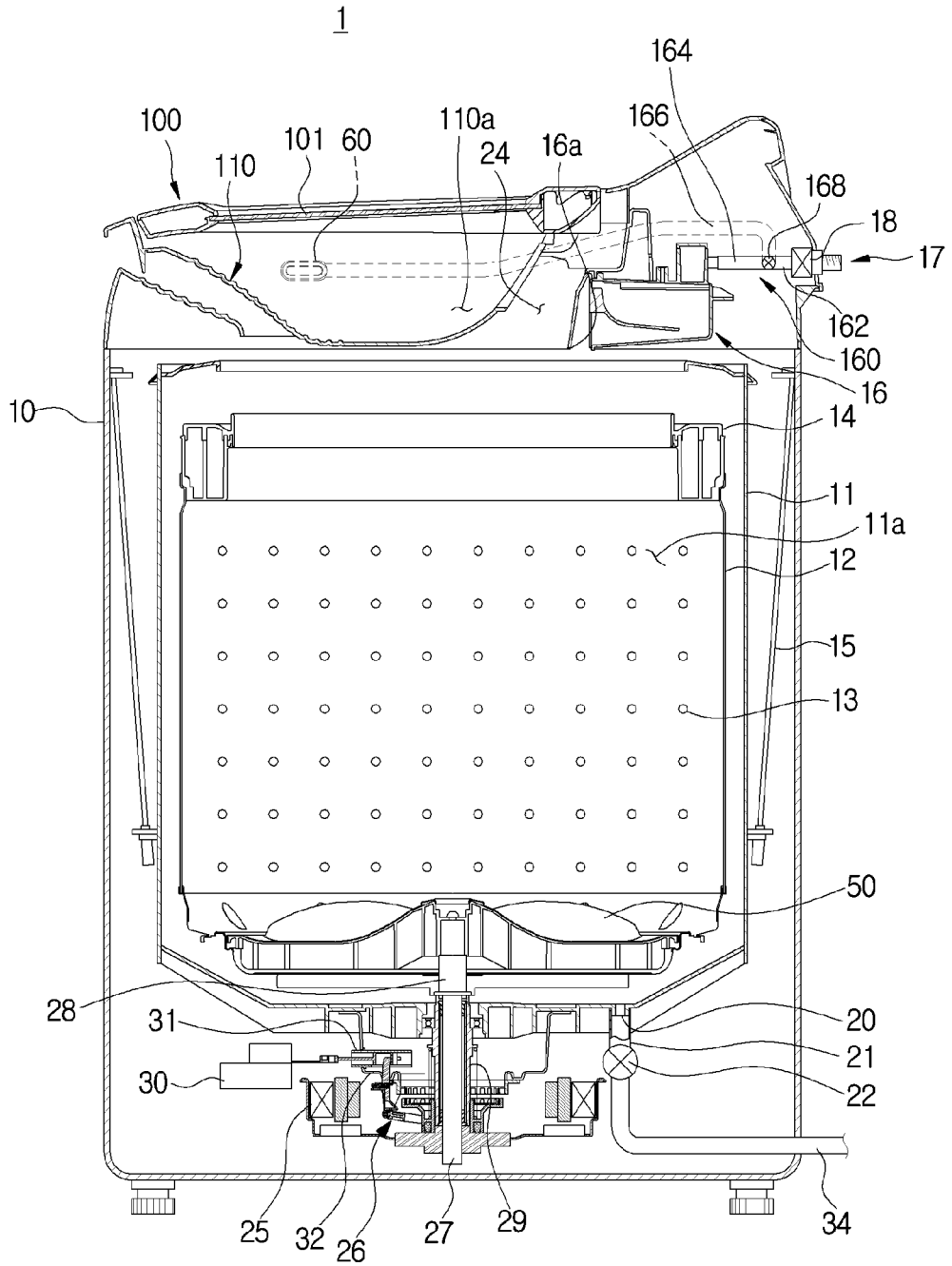
FIG. 2 is a side sectional view taken along line A-A' in FIG. 1.

As shown in FIGS. 1 and 2, a washing machine 1 includes a cabinet 10 forming an exterior thereof, a fixed tub 11 disposed inside the cabinet 10 and configured to accommodate washing water, a rotating tub 12 rotatably disposed inside the fixed tub 11, and a pulsator 50 disposed inside the rotating tub 12 and configured to generate a flow of water.

An opening 24 is formed in an upper portion of the cabinet 10 so that laundry may be put in the rotating tub 12 therethrough. The opening 24 may be opened or closed by a door 101 of a top cover 100 installed in the cabinet 10. The fixed tub 11 may be supported by a suspension device 15 in the cabinet 10.

A water supply pipe 17 configured to supply washing water to the fixed tub 11 is installed above the fixed tub 11. One side of the water supply pipe 17 is connected to an external water supply source, and the other side of the water supply pipe 17 is connected to a detergent supply device 16. Water supplied through the water supply pipe 17 is supplied into the fixed tub 11 with detergent via the detergent supply device 16. A water supply valve 18 is installed in the water supply pipe 17 to control a supply of water.

The rotating tub 12 is provided in a cylindrical shape and has an open upper portion, and a plurality of dehydration holes 13 are formed in a side surface thereof. A balancer 14 may be mounted on the rotating tub 12 so that the rotating tub 12 may stably rotate at a high speed.

A motor 25, configured to generate a driving force to rotate the rotating tub 12 and the pulsator 50, and a power switching device 26, configured to transmit the driving force generated by the motor 25 to one of or both the rotating tub 12 and the pulsator 50, are installed outside a lower side of the fixed tub 11.

A hollow type dehydration shaft 29 may be coupled to the rotating tub 12, and a washing shaft 27 installed in a hollow portion of the dehydration shaft 29 may be coupled to the pulsator 50 by a washing shaft coupling portion 28. The motor 25 may transmit the driving force to one of or both the rotating tub 12 and the pulsator 50 according to a lifting operation of the power switching device 26.

A power switching device 26 may include an actuator 30 configured to generate a driving force for switching power, a loader 31 configured to linearly move according to operation of the actuator 30, and a clutch 32 connected to the loader 31 and configured to rotate according to operation of the loader 31.

A water discharge port 20 is formed in a bottom of the fixed tub 12 to discharge washing water accommodated in the fixed tub 12, and a first water discharge pipe 21 is connected to the water discharge port 20. A water discharge valve 22 configured to control water discharge may be installed in the first water discharge pipe 21. An exit of the water discharge valve 22 may be connected to a second water discharge pipe 34 configured to discharge washing water outward.

The opening 24 is provided with a top cover 100 configured to fully cover the opening 24 from above, with the door 101 of the top cover 100, and with an auxiliary washing unit 110 provided under the door 101. The door 101 is provided at an opening provided in a central portion of the top cover 100 to open and close the opening of the top cover 100 and the opening 24 of the cabinet 10. A transparent member may be provided at the door 101 so that an inside of the washing machine 1 may be viewed from the outside even when the door 101 has closed the opening 24.

The auxiliary washing unit 110 includes an auxiliary washing space 110*a* to be capable of separately performing hand-washing. The auxiliary washing space 110*a* is provided to wash laundry separately from a main washing space 11*a* formed by the fixed tub 11 and the rotating tub 12.

Since the main washing space 11*a* and the auxiliary washing space 110*a* are separated, washing may be separately performed in each of the spaces. Further, washing in the main washing space 11*a* and the auxiliary washing space 110*a* may be simultaneously or separately performed.

The auxiliary washing unit 110 may be provided at an inner side of the door 100 to be rotatable around one side of the door 101. The auxiliary washing unit 110 may be provided to be coaxial with a rotary shaft of the door 100.

A water supply device 160 may be provided to supply water to the main washing space 11*a* and the auxiliary washing space 120*a*.

The water supply device 160 may include a water supply pipe 162, a main water supply pipe 164, an auxiliary water supply pipe 166, and a switching unit 168.

One end of the water supply pipe 162 may be connected to the water supply valve 18, and the other end of the water supply pipe 162 may be connected to the switching unit 168. The water supply pipe 162 is provided to transfer washing water supplied by the water supply valve 18 to the switching unit 168.

The main water supply pipe 164 may be provided to supply water to the main washing space 11*a*. One end of the main water supply pipe 164 may be connected to the detergent supply device 16, and the other end of the main water supply pipe 164 may be connected to the switching unit 168.

The auxiliary water supply pipe 166 may be provided to supply water to the auxiliary washing space 110*a* of the auxiliary washing unit 110. One end of the auxiliary water supply pipe 166 may be connected to the auxiliary water supply port 60, and the other end of the auxiliary water supply pipe 166 may be connected to the switching unit 168.

The switching unit 168 is provided to supply the washing water delivered from the water supply pipe 162 to any one of the main water supply pipe 164 and the auxiliary water supply pipe 166. That is, by controlling the switching unit 168, the washing water is supplied to the washing spaces through at least one of the main water supply pipe 164 and the auxiliary water supply pipe 166.

Unlike that shown in the drawings, the washing machine 1 according to one embodiment of the present disclosure may not include the auxiliary washing unit 110. That is, the top cover 100 is disposed above the cabinet 10, and when the door 101 provided in the top cover 100 is opened, the opening 24 and the opening of the top cover 100 are directly connected and a user may put laundry in the rotating tub 12.

That is, due to pin members 200 which will be described below, the washing machine 1 according to one embodiment of the present disclosure may easily prevent the top cover 100 from becoming separated from the washing machine 1, regardless of whether the auxiliary washing unit 100 is disposed in the washing machine 1.

Hereinafter, a configuration in which the top cover 100 is coupled to an upper portion of the cabinet 10 will be described in detail.

Figure 3:
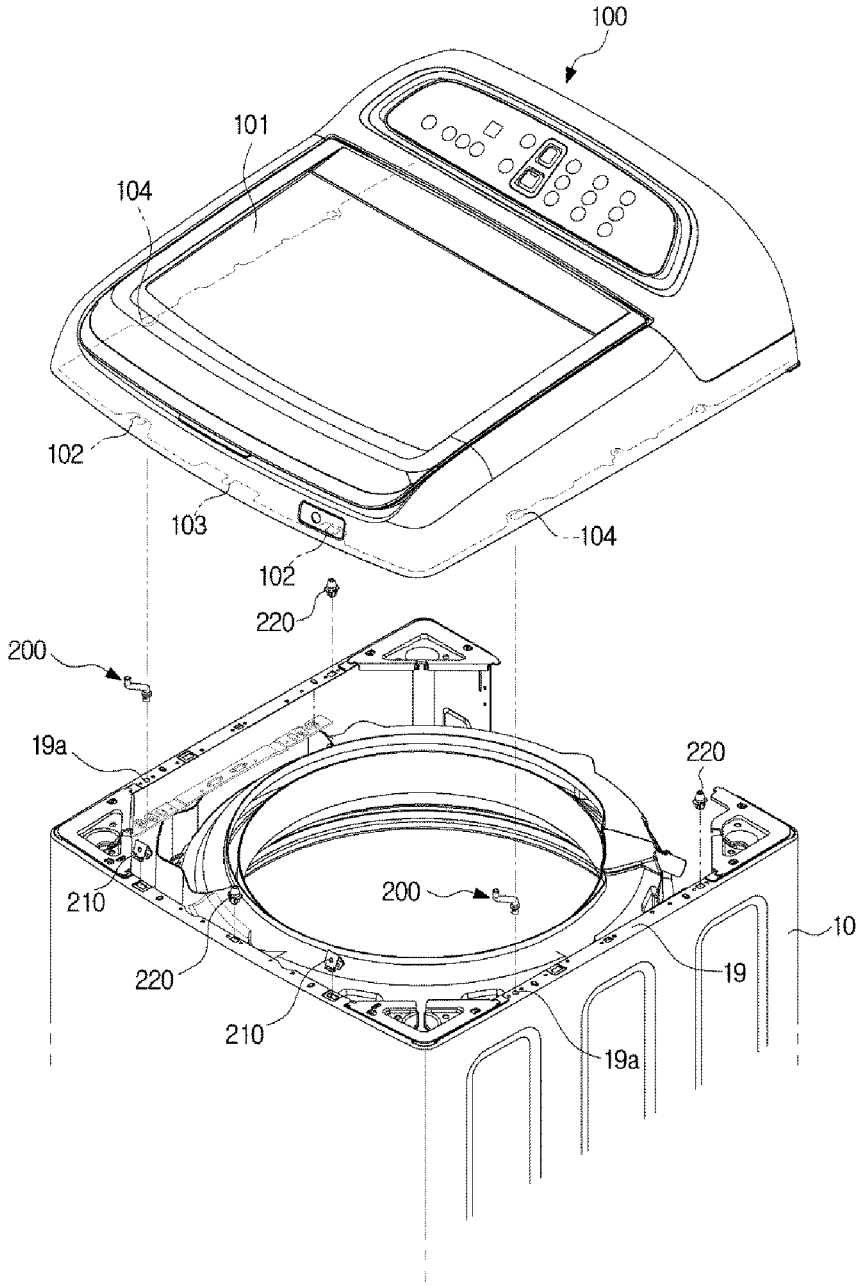
FIG. 3 is an exploded perspective view of a washing machine according to an embodiment of the present disclosure.
Figure 4:
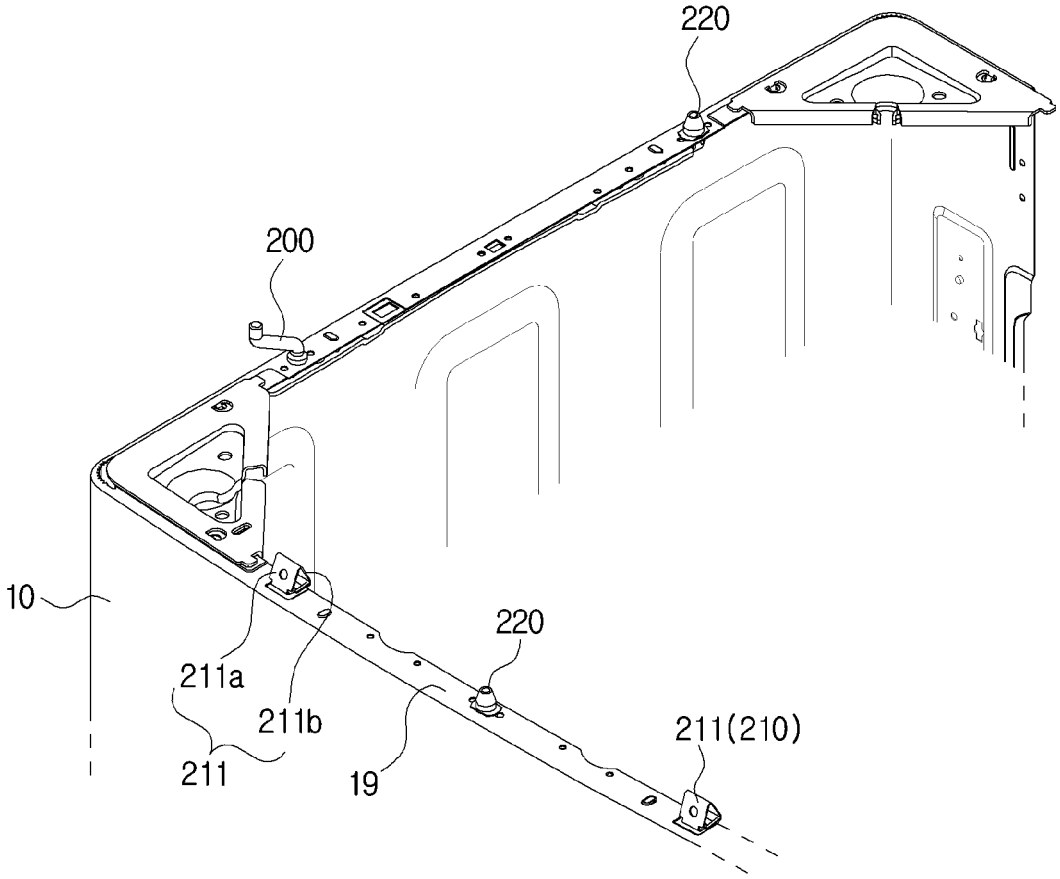
FIG. 4 is a perspective view of a front side of a cabinet of a washing machine according to an embodiment of the present disclosure.
Figure 5:
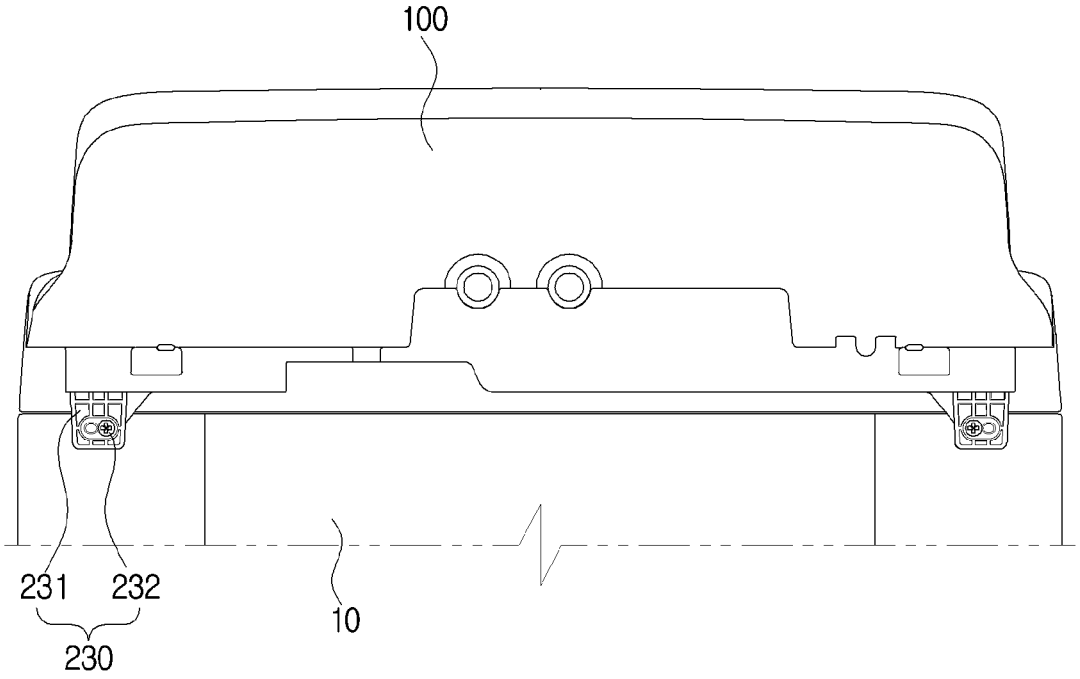
FIG. 5 is an upper rear view of a washing machine according to an embodiment of the present disclosure.

FIG. 3 is an exploded perspective view of the washing machine according to one embodiment of the present disclosure, FIG. 4 is a perspective view of a front portion of a cabinet of the washing machine according to one embodiment of the present disclosure, and FIG. 5 is a rear surface view of an upper portion of the washing machine according to one embodiment of the present disclosure.

As described above, the top cover 100 covers the upper portion of the cabinet 10 having the opening 24, and may selectively open the opening 24 via the door 101.

The cabinet 10 may include an upper flange 19 laterally bent at an upper end of the cabinet 10. The top cover 100 may be seated on the upper flange 19 and coupled to the cabinet 10.

In detail, as shown in FIG. 4, hook coupling members 210 coupled to a front portion of the top cover 100 may be provided on the a front portion of the upper flange 19. The hook coupling member 210 may include at least one hook 211 bent upward.

The hook 211 may be formed of an elastic material, and may include a first surface 211*a* of a predetermined length protruding upward from the upper flange 19 and include a second surface 211*b* of a predetermined length bent from the first surface 211*a* and extending downward. A distance between the first surface 211*a* and the second surface 211*b* is gradually increased from upper sides of the first surface 211*a* and the second surface 211*b* toward lower sides thereof, and thus the hook 211 may include side surfaces forming a triangular shape and protruding upward.

The top cover 100 may include hook holes 102 disposed in a lower portion of the top cover 100 and hook-coupled to the hooks 211. When the top cover 100 is disposed to correspond to the upper flange 19, the hook hole 102 may be provided at a location corresponding to the hook 211.

During a process of a user assembling the top cover 100, the top cover 100 may be disposed to correspond to the upper flange 19, and the hook 211, which faces upward when pressurized in a longitudinal direction, may pass through and be hook-coupled to the hook hole 102.

That is, the hook hole 110 may include a hole having a smaller width than a planar area formed by the separation of lower sides of the first surface 211*a* and the second surface 211*b*. Accordingly, the hook 211 applies an elastic force to the lower sides of the first surface 211*a* and the second surface 211*b* by pressurizing the lower sides while passing through the hook hole 102, and then the hook hole 102 and one of the first surface 211*a* and the second surface 211*b* are elastically returned to original locations thereof, and thus the hook 211 may be hook-coupled to the hook hole 102.

Further, when the top cover 100 is coupled to the upper flange 19, a guide member 220 may be provided on the front portion of the upper flange 19 to guide the top cover 100 so that the top cover 100 is disposed at the correct location.

The guide members 220 may be disposed to be spaced a predetermined distance from each other on a side or rear portion of the upper flange 19 along the upper flange 19 as well as disposed on the front portion of the upper flange 19. The guide member 220 is provided in a protrusion form protruding upward and having a predetermined length, and although not shown in the drawings, the guide member 220 may be coupled to a guide groove 103 disposed in the lower portion of the top cover 100 so that the top cover 100 may be disposed at the correct location.

Since the guide member 220 is provided in a cylindrical shape in which a diameter thereof is gradually decreased in a direction in which the guide member 220 protrudes, a user may easily couple the guide member 220 to the guide groove 103 in the assembly process of the top cover 100.

A user may easily couple the hook 211 to the hook hole 102 along the guide member 220.

That is, the front portion of the top cover 100 may be hook-coupled to the upper flange 19 by the hook coupling member 210 disposed on the upper portion of the upper flange 19.

As shown in FIG. 5, a rear portion of the top cover 100 may be coupled to the cabinet 10 by screw coupling members 230 formed on rear surfaces of the top cover 100 and the cabinet 10.

After the front portion of the top cover 100 is coupled to the hook coupling members 210, the screw coupling members 230 may be disposed on the rear surface of the cabinet 10 to improve coupling between the top cover 100 and the cabinet 10.

The screw coupling member 230 may include a screw bracket 231 extending between the rear surfaces of the top cover 100 and the cabinet 10. In one embodiment of the present disclosure, the screw bracket 231 may be provided to extend from the rear surface of the top cover 100 toward the rear surface of the cabinet 10.

However, the screw coupling member 230 is not limited thereto, and may be provided to extend between the rear surfaces of the top cover 100 and the cabinet 10 as a component separate from the top cover 100.

The screw bracket 231 may include screw coupling hole 232 at a location corresponding to the rear surface of the cabinet 10 which will be screw-coupled with the screw bracket 231. The screw coupling member 230 is coupled with the screw coupling hole 232, and thus the rear portion of top cover 100 may be coupled to the screw coupling member 230.

However, when the screw bracket 231 is formed of a separate material from the top cover 100, two screw coupling holes 232 may be provided to correspond to the rear surfaces of the top cover 100 and the cabinet 10.

That is, as shown in FIGS. 4 and 5, since the front portion of the top cover 100 is coupled to hook coupling member 210 and the rear portion of the top cover 100 is coupled to the screw coupling member 230, both the front and rear portion of the top cover 100 may be coupled to the cabinet 10.

In a top cover of a conventional washing machine, like in one embodiment of the present disclosure, the top cover is coupled to a cabinet by screw coupling at a front portion of the top cover. As shown in one embodiment of the present disclosure, although screw coupling the top cover and the cabinet is more advantageous for improved coupling than hook-coupling, a screw-coupling structure is exposed when viewed from the front or above, and thus an aesthetic exterior of the washing machine is degraded.

Further, when the top cover is injection-molded using a metal material instead of plastic, since forming a screw coupling hole for screw coupling in a front portion of the top cover formed of the metal material is difficult in a manufacturing process, washing machine manufacturability is reduced.

Accordingly, in the conventional washing machine, a rear side of the washing machine not visible to a user is screw-coupled as shown in one embodiment of the present disclosure, and a front side of the washing machine visible to the user is coupled by a hook coupling member configured to couple the top cover to the cabinet at an inner side of the top cover.

In this case, in the above-described top cover coupling method, when an impact is applied from an outside of the washing machine or a force is applied upward to the washing machine due to abnormal vibration in the washing tub, a hook becomes separated from hook-coupling between the top cover and the cabinet, and the top cover becomes separated from an upper side of the cabinet.

Since the washing machine 1 according to one embodiment of the present disclosure further includes the pin members 200 provided on the upper side of the cabinet 10 to prevent the top cover 100 from becoming separated from the cabinet 10, the pin members 200 may prevent the top cover 100 from becoming separated from the cabinet 10.

Hereinafter, the pin members 200 configured to prevent separation of the top cover 100 and fixing brackets 300 configured to fix the pin members 200 in the upper flange 19 will be described in detail.

Figure 6:
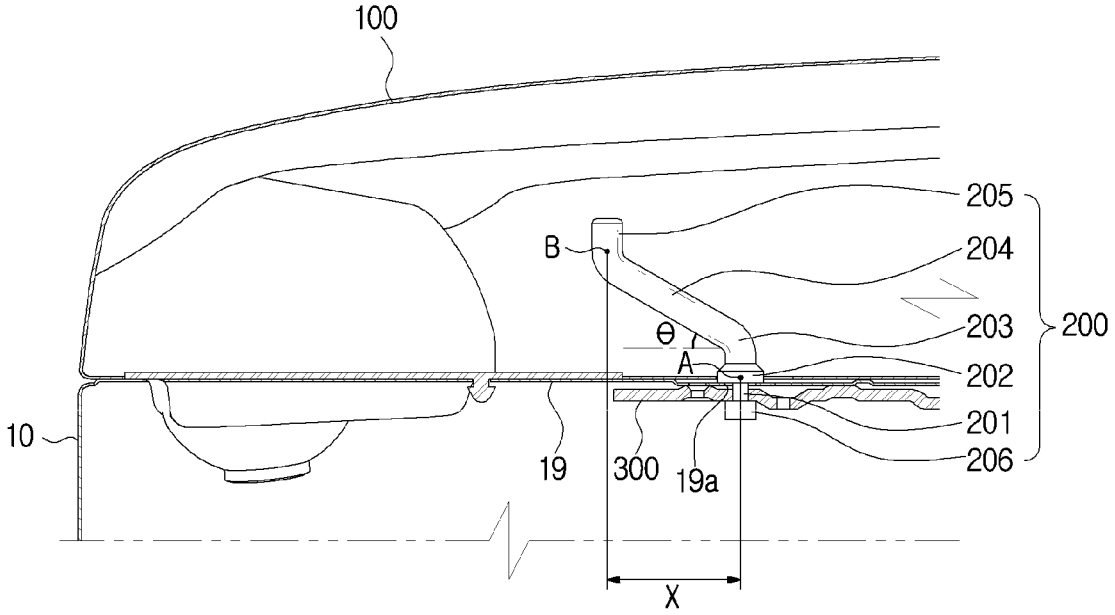
FIG. 6 is a side sectional view taken along the line B-B' in FIG. 1.
Figure 7:
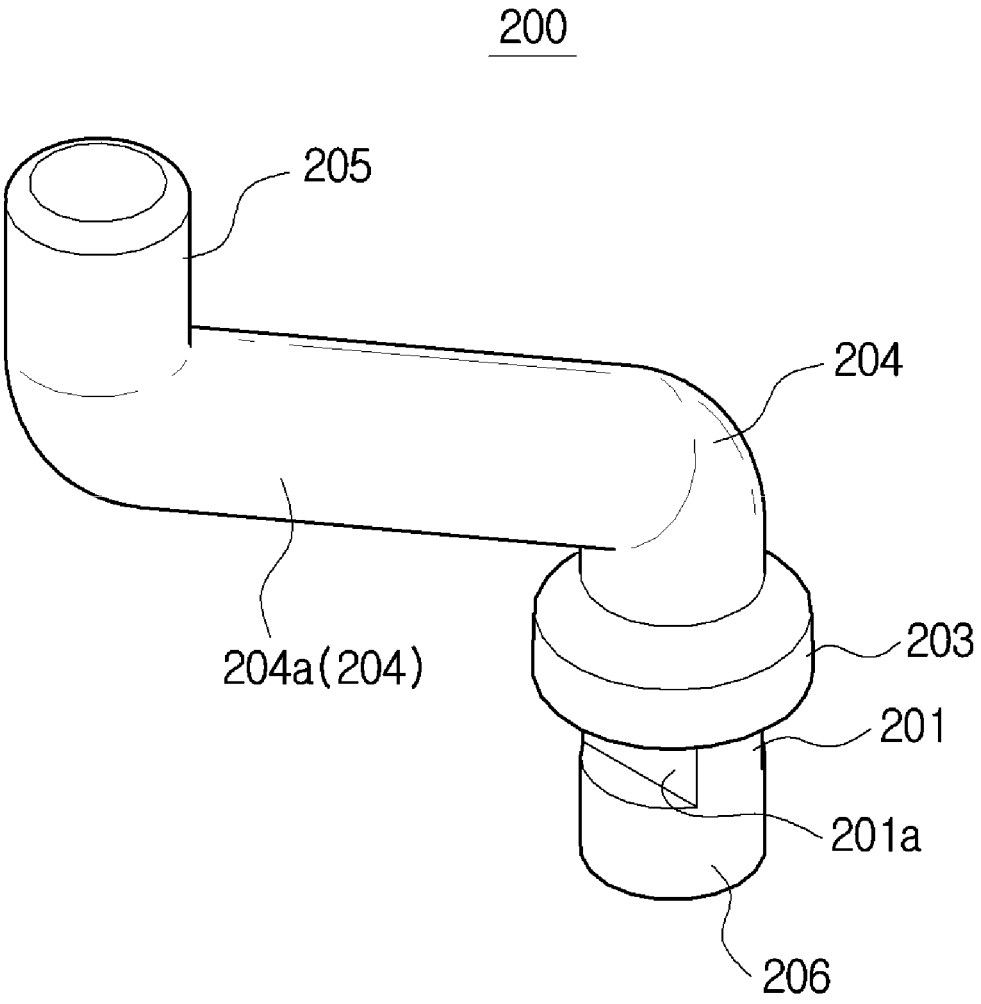
FIG. 7 is a perspective view of a fin member of a washing machine according to an embodiment of the present disclosure.
Figure 8:
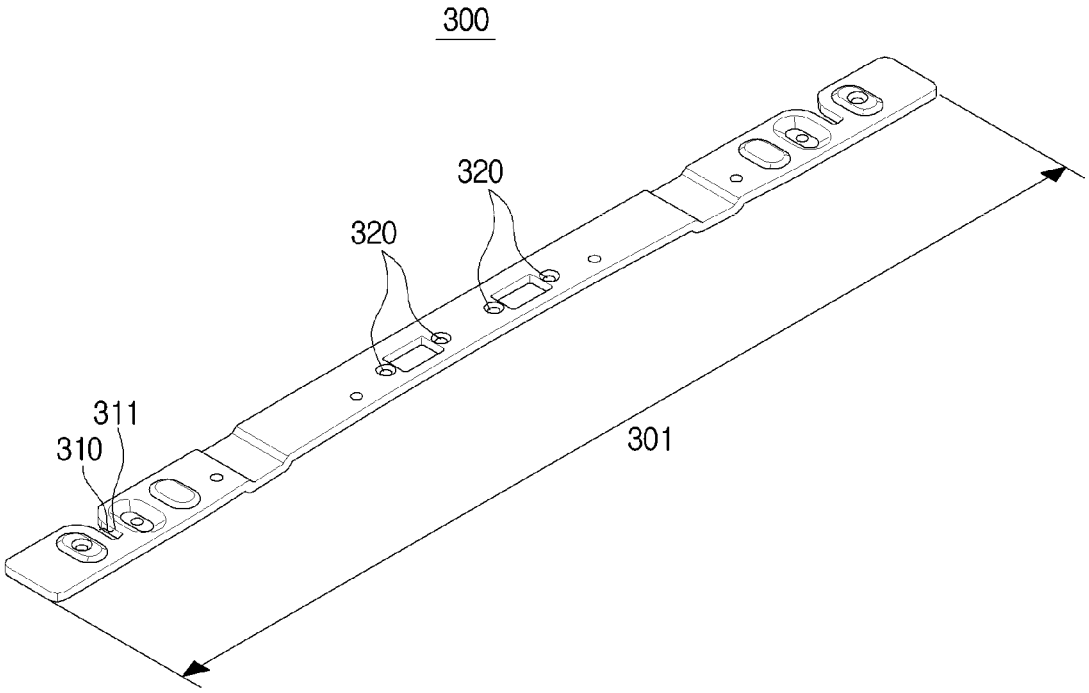
FIG. 8 is a perspective view of a fixing bracket of a washing machine according to an embodiment of the present disclosure.

FIG. 6 is a side sectional view of B-B' in FIG. 1, FIG. 7 is a perspective view of a pin member of the washing machine according to one embodiment of the present disclosure, and FIG. 8 is a perspective view of a fixing bracket of the washing machine according to one embodiment of the present disclosure.

As shown in FIG. 3 and FIG. 6, the pin members 200 may be disposed on the upper side of the cabinet 10. In detail, the pin members 200 may be inserted into the upper flange 19 and supported on the cabinet 10.

Since the upper flange 19 includes a coupling hole 19*a* to which the pin member 200 is inserted and coupled, the pin member 200 may be inserted into the upper flange 19. The pin member 200 may have a shape configured to protrude approximately upward, pass through the through hole 104 disposed in the top cover 100, and be disposed on the cabinet 10.

Since the through hole 104 is provided in the top cover 100 like the hook hole 102 and the guide groove 103, specifically in a flange bent at a lower end portion of the top cover 100 and extending in a lateral direction, the through hole 104 may not be exposed to the outside when the top cover 100 is coupled to the cabinet 10.

When the top cover 100 is coupled to the cabinet 10, the through holes 104 may first fit onto the pin members 200 to dispose the top cover 100 on the upper flange 19, and then, as described above, the top cover 100 may be coupled to the cabinet 10 by the hook coupling member 210 and the screw coupling member 230.

A separation prevention portion 204 obliquely extending from the pin member 200 which will be described below may pass through the through hole 104, and the through hole 104 may be located at a first location A of the fixing bracket 300 facing the upper flange 19 and disposed parallel to the upper flange 19.

As shown in FIGS. 6 and 7, the pin member 200 may include a coupling portion 201 inserted into the coupling hole 19*a* of the upper flange 19, a through portion 202 extending upward from the coupling portion 201 and located to correspond to the first location A at which the through hole 104 is located, a bent portion 203 extending upward from the through portion 202 and configured to bend the pin member 200 so that the pin member 200 extends toward a front portion of the cabinet 10, the separation prevention portion 204 obliquely extending upward from the bent portion 203 toward the front portion of the cabinet 10, and a guide portion 205 bent upward from the separation prevention portion 204 and extending toward an upper portion of the cabinet 10.

Further, the pin member 200 may further include a restrainer 206 extending downward from the coupling portion 201 and configured to restrain the fixing bracket 300 when the fixing bracket 300, which will be described below, is coupled to the coupling portion 201.

As described above, the coupling portion 201 may be a part of the pin member 200 inserted into the coupling hole 19*a* of the upper flange 19. The coupling portion 201 and the restrainer 26 extending downward from the coupling portion 201 may be inserted into the coupling hole 19*a* and disposed at a lower level than the upper flange 19.

Each of the coupling portion 201 and the binder 206 may have a diameter smaller than or corresponding to a diameter of the coupling hole 19*a* to be inserted into the coupling hole 19*a*.

The coupling portion 201 may include one side having a fixing surface 201*a* fixed by the fixing bracket 300 which will be described below. A pair of fixing surfaces 201*a* may be provided to be disposed in parallel in a lateral direction of the cabinet 10.

Due to the fixing surface 201*a* of the coupling portion 201, a diameter of at least a portion of the coupling portion 201 may be provided to be smaller than a diameter of at least a portion of the binder 206. Accordingly, since an outer circumferential surface of the binder 206 further protrudes outward than the fixing surface 201*a*, the fixing bracket 300, which will be described below, may be prevented from hanging downward. This case will be described in detail below.

The through portion 202 may extend upward from the coupling portion 201. The through portion 202 may be a part of pin member 200 and may correspond to the first location A at which the through hole 104 is disposed when the top cover 100 is coupled to the cabinet 10.

The through portion 202 may be provided to have a larger diameter than the coupling hole 19*a*. Accordingly, the through portion 202 may serve as a stopper to prevent the pin member 200 from separating into the coupling hole 19*a*.

The bent portion 203 may be provided to be positioned upward from the through portion 202. The bent portion 203 may bend a part of the pin member 200 so that the pin member 200 extending upward obliquely extends upward toward the front portion of the cabinet 10.

The separation prevention portion 204 may be provided in a part of the pin member 200 extending toward the front portion of the cabinet 10 due to the bent portion 203. The separation prevention portion 204 is the part of the pin member 200 obliquely extending upward from the coupling portion 201 and may prevent the through hole 104 from decoupling from the pin member 200. This will be described in detail below.

The guide portion 205 extending in a direction corresponding to a direction to which the coupling portion 201 extends may be provided on the separation prevention portion 204. That is, the guide portion 205 may be a part of the pin member 200 bent to extend in a direction perpendicular to the cabinet 10 from an upper end of the obliquely extending separation prevention portion 204.

When a user couples the top cover 100 to the cabinet 10, the guide portion 205 may extend in a direction corresponding to a direction in which the user couples the top cover 100 to the cabinet 10 so that the through hole 104 may easily fit onto the pin member 200. That is, although the user may vertically couple the top cover 100 to the cabinet 10, when one end portion of the pin member 200 is formed in an obliquely upward direction like the separation prevention portion 204, the through hole 104 is coupled to the pin member 200 in a direction different from the direction in which the top cover 100 is coupled to the cabinet 10, and thus it may be difficult for the user to fit the through hole 104 onto the pin member 200.

To prevent the above difficulty, the guide portion 205 may be provided in a direction perpendicular to the cabinet 10 and the user may easily fit the through hole 104 onto the pin member 200.

The washing machine 1 may further include the fixing brackets 300 configured to fix the coupling portion 201 and disposed below the upper flange 19 to support the coupling portion 201 inserted into the coupling holes 19*a*.

The fixing bracket 300 may be provided in a bar shape including a long side 301, and may include a fixing groove 310 incised in one direction of the fixing bracket 300 and coupled to the coupling surface 201*a* of the coupling portion 201 so as to fix the coupling portion 201.

The fixing groove 310 may be provided to be incised in the one direction of the fixing bracket 300 so as to have a ⊏ shape. Since fixing surfaces 311 are formed at both ends of the fixing groove 310 and the coupling surfaces 201*a* of the coupling portion 201 are inserted into the fixing grooves 310, the fixing surfaces 311 may come into contact with the coupling surfaces 201*a*.

That is, since the fixing bracket 300 may be coupled to the coupling portion 201 below the upper flange 19 in the lateral direction of the cabinet 10, the coupling portion 201 is inserted into the fixing groove 310 incised in one direction of the fixing bracket 300, and the fixing bracket 300 may fix the coupling portion 201 to the upper flange 19.

Further, as described above, when the coupling portion 201 is coupled to the fixing bracket 300, the restrainer 206 extending downward from the coupling portion 201 may restrain a lower portion of the fixing bracket 300 to prevent separation of the fixing bracket 300.

In addition, auxiliary coupling holes 320 may be provided in the fixing bracket 300 to couple the fixing bracket 300 to a lower portion of the upper flange 19. The auxiliary coupling holes 320 may be coupled to screw members configured to pass through the upper flange 19 and vertically couple the upper flange 19 to the fixing bracket 300. Accordingly, the fixing bracket 300 may be stably supported on the lower portion of the upper flange 19.

The pin members 200 may be easily and stably supported by the fixing bracket 300. Conventional components corresponding to pin members are engaged with the upper flange 19 via a screw coupling method, but the pin members 200 according to one embodiment of the present disclosure are provided in a shape obliquely extending in one direction instead of in a vertically extending pin shape and thus may be difficult to be screw-coupled.

Accordingly, although workability of coupling the pin members 200 to the upper flange 19 may be lowered, according to one embodiment of the present disclosure, workability can be improved by a method of simply coupling the fixing bracket 300 in the lateral direction of the cabinet 10.

Further, as described above, the fixing bracket 300 may be formed in a bar shape including the long side 301, and thus, when the fixing bracket 300 is coupled to the lower portion of the upper flange 19, since the fixing bracket 300 may serve to reinforce the strength of the upper flange 19, the strength of the upper flange 19 is improved by the fixing bracket 300 and the upper flange 19 is not damaged even upon receiving an impact due to an external force, and thus the coupling between the upper flange 19 and the top cover 100 may be prevented from being decoupled by damage to the upper flange 19.

Hereinafter, the separation prevention portion 204 will be described in detail.

As described above, the separation prevention portion 204 is the part of the pin member 200 obliquely extending upward from the bent portion 203.

When an impact is applied to the washing machine 1 or abnormal rotation occurs due to a non-uniform arrangement of laundry being cleaned in the rotating tub 12, and when a force is applied in an upper portion of the cabinet 10, the top cover 100 may receive the force in an upward direction and be separated upward from the cabinet 10. When the top cover 100 starts to separate upward from the cabinet 10, the separation prevention portion 204 may become linked with the top cover 100 to restrict movement of the through hole 104 being moved upward so as to restrict the top cover 100 from becoming separated in an upward direction from the cabinet 10.

In detail, since the rear portion of the top cover 100 is stably coupled to the cabinet 10 by the screw coupling member 230 but the front portion of the top cover 100 is coupled to the cabinet 10 by the hook coupling member 210, when the top cover 100 is pressurized in an upward direction, the hook-coupling between the hook 211 and the hook hole 102 becomes decoupled, the hook hole 102 is moved from the hook 211, and thus the front portion of the top cover 100 may become separated from the cabinet 10.

To prevent the above separation, when the front portion of the top cover 100 starts to separate upward from the cabinet 10, a moving distance of the through hole 104 may be restricted to a predetermined distance to prevent the top cover 100 from becoming completely separated from the cabinet 10.

That is, the separation prevention portion 204 may obliquely extend upward from the bent portion 203 at an angle of approximately 25° to 35°. Accordingly, when the through hole 104 and the top cover 100 are moved upward from the first location A, since the through hole 104 comes into contact with a separation prevention surface 204*a* forming an outer circumferential surface of the separation prevention portion 204, the through hole 104 may be restricted to being moved up to a second location B of the upper end of the separation prevention portion 204, and may drop and return to the first location A due to gravity.

In other words, since the through hole 104 may be moved only from the first location A to the second location B due to the separation prevention portion 204, the through hole 104 may be restricted from being moved upward beyond the second location B, preventing the top cover 100 from becoming completely separated from the cabinet 10.

When a lateral distance from the first location A to the second location B is defined as a separation prevention distance X, the through hole 104 is provided to be movable within the separation prevention distance X to prevent separation of the top cover 100. That is, since the separation prevention portion 204 is obliquely formed, the separation prevention portion 204 may secure the separation prevention distance X of a predetermined distance and may prevent the through hole 104 from becoming separated from the pin member 200.

As described above, an inclination angle Θ of the bent portion 203 may be preferably formed at 25° to 35°. When the inclination angle Θ is 25° or less, the separation prevention distance X may increase and the through hole 104 may be more stably prevented from becoming separated from the pin member 200, but, since the inclination angle Θ is too low, the through hole 104 is difficult to pass through the pin member 200, and thus assembly therebetween may be difficult.

Further, when the inclination angle Θ is provided to be 35° or more, since the separation prevention distance X decreases and the through hole 104 may be located outside the separation prevention distance X, the through hole 104 may become separated from the pin member 200, and accordingly, the top cover 100 may become separated from the cabinet 10.

Accordingly, the inclination angle Θ is preferably provided to be in a range of 25° to 35°.

Hereinafter, the through hole 104 configured to fit onto the pin member 200 and a way in which the through hole is moved along the pin member 200 will be described in detail.

Figure 9:
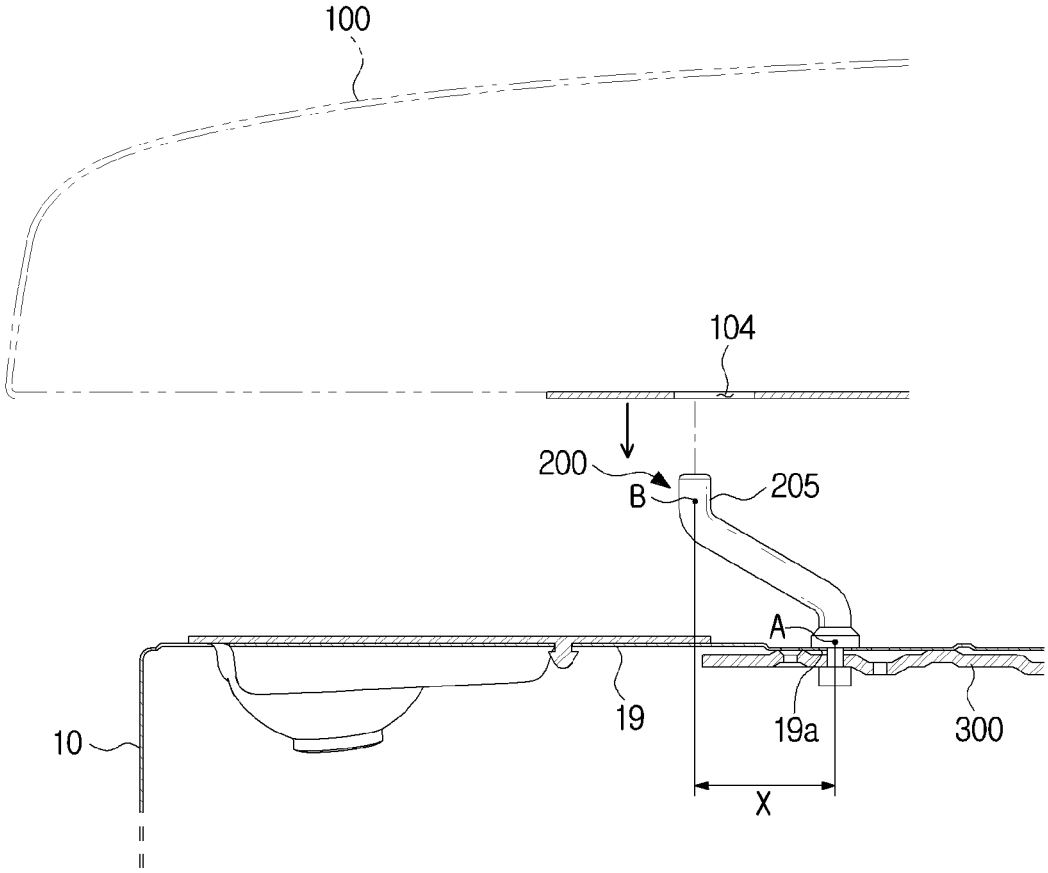
FIG. 9 is a view showing a state in which a through hole of a washing machine does not pass through a pin member according to an embodiment of the present disclosure.
Figure 10:
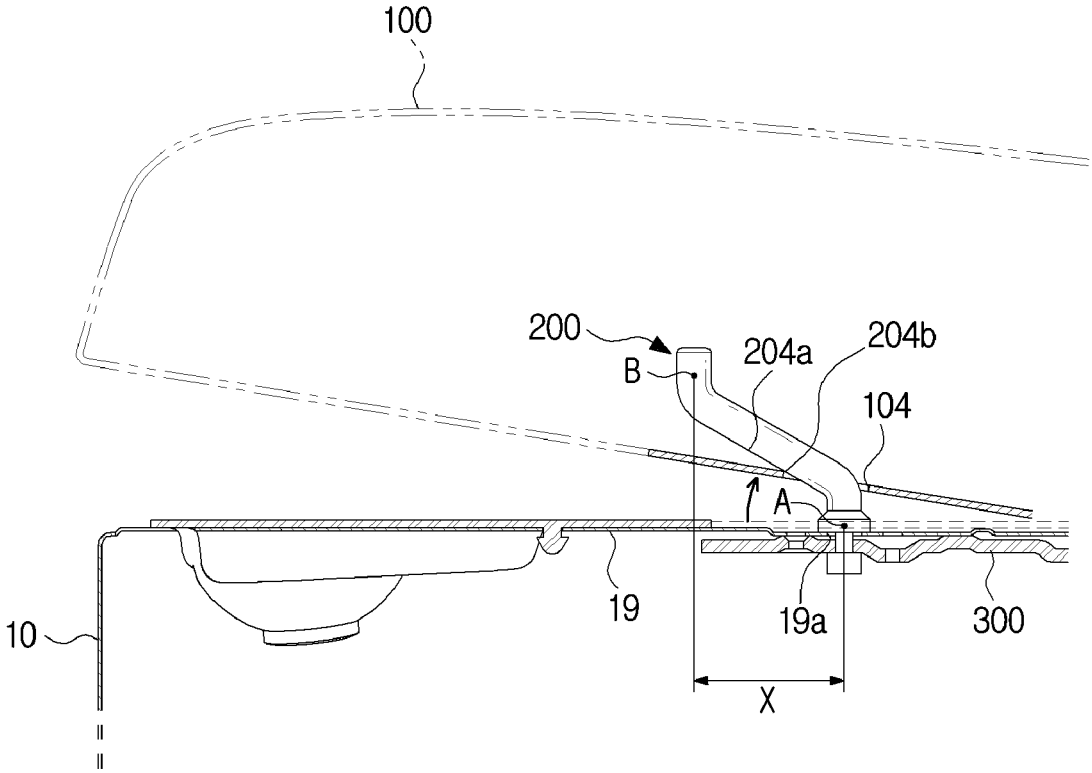
FIG. 10 is a view illustrating a state in which a through hole of a washing machine starts to separate from a pin member according to an embodiment of the present disclosure.
Figure 11:
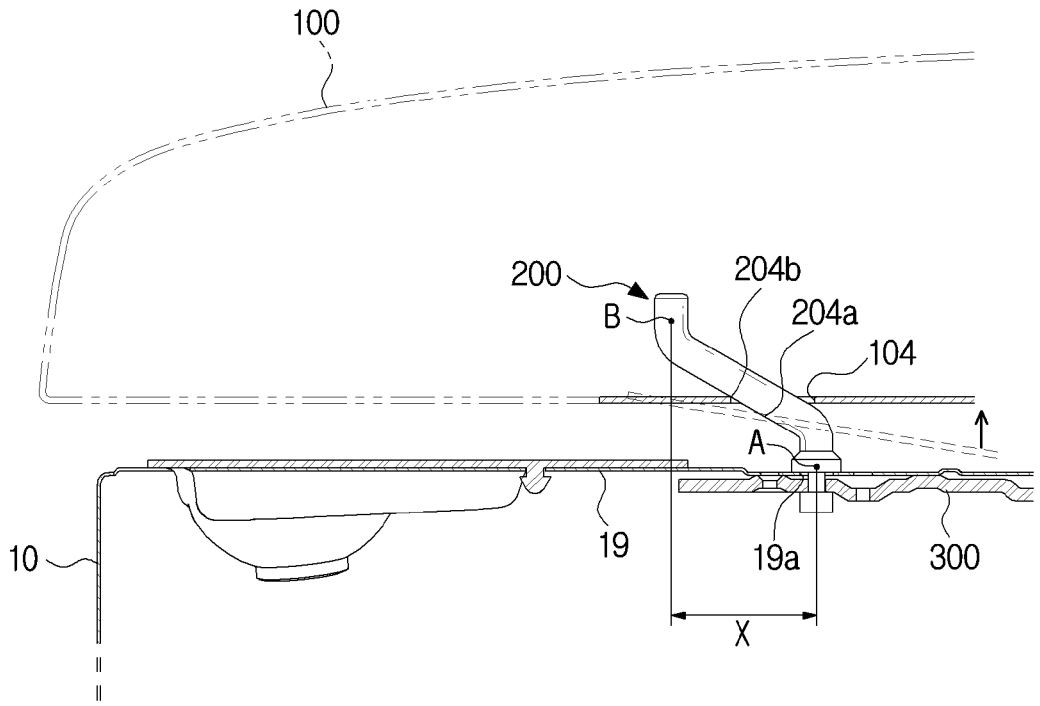
FIG. 11 is a view illustrating a state in which the through hole of the washing machine is restricted when the fan member is detached according to the embodiment of the present disclosure.

FIG. 9 is a view of a through hole of the washing machine according to one embodiment of the present disclosure before fitting onto a pin member, FIG. 10 is a view of a state in which the through hole of the washing machine according to one embodiment of the present disclosure starts to become separated from the pin member, and FIG. 11 is a view of a state in which the through hole of the washing machine according to one embodiment of the present disclosure becomes restricted when upon separating from the pin member.

As shown in FIG. 9, when the top cover 100 is coupled to the cabinet 10, the top cover 100 may be vertically coupled to the upper side of the cabinet 10. Accordingly, as described above, the through hole 104 provided in the cabinet 10 may fit onto the pin member 200 first.

In this case, the through hole 104 may easily fit onto the pin member 200 along the guide portion 205 provided in the upper portion of the pin member 200 and configured to easily fit the through hole 104 onto the pin member 200.

The through hole 104 moved along the guide portion 205 may be moved along the separation prevention portion 204 and the bent portion 203 and located at the through portion 202 corresponding to the first location A. When the through hole 104 is located at the through portion 202, the front portion of the top cover 100 is coupled to the hook coupling members 210, and the rear portion of the top cover 100 may be coupled to the screw coupling member 230.

Further, as shown in FIG. 10, when the top cover 100 receives a force in the upward direction, the top cover 100 may be moved upward, and accordingly, the through hole 104 may be moved upward. As described above, since the rear portion of the top cover 100 is coupled to the screw coupling member 230, the front portion of the top cover 100 may be moved upward first.

Accordingly, the through hole 104 may be moved upward as a whole so that a front side thereof becomes further upwardly oblique. The through hole 104 may be moved upward and come into contact with the separation prevention surface 204*a* of the separation prevention portion 204.

In detail, one side of the through hole 204 comes into contact with a contact point 204*b* at the separation prevention surface 204*a*, and accordingly, the through hole 204 may be restricted from being moved upward beyond the contact point 204*b*.

That is, the contact point 204*b* may move the through hole 204 in a downward direction to prevent the through hole 204 from being moved upward. The contact point 204*b* may be formed at the separation prevention surface 204*a* formed between the first location A and the second location B and may prevent the through hole 204 from being moved upward beyond the second location B.

As shown in FIG. 11, since the through hole 104 may be moved along only the separation prevention portion 204 even when the rear portion of the top cover 100 instead of the front portion of the top cover 100 is pressurized in the upward direction, the top cover 100 may be prevented from becoming completely separated from the cabinet 10.

That is, since the through hole 104 may be provided to come into contact with the separation prevention surface 204*a* even when the rear portion of the top cover 100 is moved upward, the contact point 204*b* may be located at a front side of the separation prevention surface 204*a*, and, although not shown in the drawings, when the through hole 104 is moved further upward, since the separation prevention surface 204*a* may come into contact with the through hole 104, the contact point 204*b* may be located at a rear side of the separation prevention surface 204*a*.

Accordingly, the through hole 104 may not become separated from the separation prevention portion 204 even when moved upward in any direction. Further, since the through hole 104 may be moved within the separation prevention distance X and may not be moved upward beyond the second location B, the top cover 100 may be moved by a predetermined distance with respect to the cabinet 10, but the movement of the through hole 104 is restricted by the pin member 200 so that the top cover 100 may not become separated from the cabinet 10 and may return to an original location after being moved by the predetermined distance. Therefore, the top cover 100 may be stably coupled to the cabinet 10.

Although a few embodiments of the present disclosure have been shown and described, it should be appreciated by those skilled in the art that changes may be made to the embodiments without departing from the principles and spirit of the present disclosure, and the scope of the present disclosure is defined in the claims and their equivalents.

The invention claimed is:

1. A washing machine comprising:

a cabinet;

a top cover including a through hole and coupled to an upper side of the cabinet, and a pin member coupled to the upper side of the cabinet, the pin member including:

a coupling portion coupled to the cabinet;

a separation prevention portion extending obliquely from the coupling portion at an angle of approximately 25° to 35° relative to a horizontal axis, at least a portion of the separation prevention portion being configured to pass through the through hole and configured to limit an amount of movement of the top cover during operation of the washing machine; and a guide portion extending from the separation prevention portion in an upward direction perpendicular to the upper side of the cabinet, so that the through hole is configured to be guided by the guide portion and to be movable along the separation prevention portion.

2. The washing machine of the claim 1, wherein:

the cabinet includes an upper flange bent from an upper end portion of the cabinet; and the upper flange includes a coupling hole into which the coupling portion is inserted.

3. The washing machine of the claim 2, wherein:

when the top cover is coupled to the upper flange, the through hole is located at a first location; and when the through hole is moved from the first location, the separation prevention portion comes into contact with at least a part of the through hole to limit the amount of movement of the top cover.

4. The washing machine of the claim 3, wherein:

the through hole is movable up to a second location configured to come into contact with at least one side of the separation prevention portion when moved from the first location; and when the through hole is located at the second location, the through hole is configured to be moved by the at least one side of the separation prevention portion so that the through hole returns to the first location.

5. The washing machine of the claim 2, wherein an inclination angle of the separation prevention portion with respect to the upper flange is 35° or less.

6. The washing machine of the claim 2, further comprising a fixing bracket coupled to the coupling portion below the upper flange to fix the coupling portion inserted into the coupling hole.

7. The washing machine of the claim 6, wherein the fixing bracket includes a fixing groove incised in one direction of the fixing bracket, and wherein the fixing groove is coupled to the coupling portion in a lateral direction of the cabinet.

8. The washing machine of the claim 7, wherein the fixing bracket includes an auxiliary coupling hole configured to be vertically screw-coupled with the upper flange.

9. The washing machine of the claim 6, wherein the pin member extends downward from the coupling portion and further includes a binder configured to bind the fixing bracket to prevent the fixing bracket from becoming separated from the coupling portion, and wherein a diameter of one side of the binder is provided to correspond to or be larger than a diameter of one side of the coupling portion.

10. The washing machine of the claim 2, wherein the pin member is located at a front portion of the upper flange.

11. The washing machine of the claim 10, further comprising a hook member provided in the front portion of the upper flange and hook-coupled to the top cover.

12. The washing machine of the claim 11, further comprising a screw coupling member disposed on a rear surface of the cabinet and configured to screw-couple the cabinet and the top cover.

13. The washing machine of the claim 1, wherein the through hole includes a long hole having a long side extending in a direction corresponding to a direction to which the separation prevention portion extends.

14. The washing machine of the claim 1, wherein the pin member further includes:

a first location at which the through hole is located and a second location located above the first location; and a bent portion in which the second location is located obliquely upward from the first location so that the through hole is configured to be moved within a separation prevention distance defined as a lateral distance between the first location and the second location when the top cover becomes separated from the cabinet.

* * * * *